US007530523B1

(12) United States Patent
Murray

(10) Patent No.: US 7,530,523 B1
(45) Date of Patent: May 12, 2009

(54) RECEIVER HITCH SUPPORTED WIRE OR CABLE DISPENSER

(76) Inventor: Ronald L. Murray, 19950 Mynster Springs Rd., Council Bluffs, IA (US) 51503

( * ) Notice: Subject to any disclaimer, the term of this patent is extended or adjusted under 35 U.S.C. 154(b) by 184 days.

(21) Appl. No.: 11/586,858

(22) Filed: Oct. 26, 2006

(51) Int. Cl.
*B65H 16/02* (2006.01)

(52) U.S. Cl. ..... 242/557; 224/519

(58) Field of Classification Search ..... 242/557, 242/590, 591, 594, 594.3, 594.4, 594.5, 594.6, 242/597, 597.1, 597.4, 588, 550, 570, 533.8, 242/403; 224/497, 504, 506, 519, 521; 248/291.1, 248/240, 236; 211/85.5, 44, 96, 99, 100, 211/101, 168, 171, 172, 173
See application file for complete search history.

(56) References Cited

U.S. PATENT DOCUMENTS 3,934,655 A 1/1976 Whistle
5,476,234 A 12/1995 St. Pierre
5,568,900 A 10/1996 Conroy
5,582,216 A 12/1996 Smith et al.
5,632,470 A 5/1997 Leland
6,182,920 B1 * 2/2001 Watkins ..... 242/594.4
6,460,745 B1 * 10/2002 Weaver ..... 224/519
6,685,132 B1 * 2/2004 Allen ..... 242/557
6,874,667 B2 * 4/2005 Dykstra et al. ..... 224/498

* cited by examiner

*Primary Examiner*—Peter M Cuomo
*Assistant Examiner*—Juan J Campos
(74) *Attorney, Agent, or Firm*—Dennis L. Thomte; Thomte Patent Law Office LLC

(57) ABSTRACT

A wire or cable dispenser comprising a drawbar inserted into a typical hitch receiver of a vehicle with the rearward end of the drawbar having a support member pivotally secured thereto which extends upwardly and rearwardly therefrom in its dispensing position and which may be folded flat against the upper surface of the drawbar for purposes of storage or transport. Rods are extended through the drawbar and the support member for supporting spools of wire or cable on the opposite ends thereof. The rods may be stowed within the drawbar and/or support member with the dispenser including a convenient means for stowing various pins thereon so that the pins do not become lost or misplaced.

1 Claim, 4 Drawing Sheets

RECEIVER HITCH SUPPORTED WIRE OR CABLE DISPENSER

BACKGROUND OF THE INVENTION

1. Field of the Invention

This invention relates to a wire or cable dispenser and more particularly to a wire or cable dispenser which may be selectively secured or received within a receiver hitch mounted at the rear end of a vehicle. More particularly, the invention relates to a dispenser which may accommodate a plurality of wire or cable spools mounted thereon and which may be easily moved from an operative position to a folded transport or stowed position.

2. Description of the Related Art

Many types of wire or cable dispensers, sometimes referred to as wire caddy carts, have been previously provided and even have been designed to as to be secured to a vehicle hitch. See, for example, U.S. Pat. Nos. 3,934,655; 5,476,234; 5,568,900; 5,582,216; and 5,632,470. Applicant has been working in the electrical wiring art for many years and has found that it is always a problem to unwind electrical wire from the spool upon which it is wound. The wire caddy carts previously available are not convenient to use and occupy considerable space when not being used. Further, the wire caddies with which applicant is familiar do not have the ability to support a large number of wire spools thereon from a vehicle receiver hitch. Additionally, the prior art wire caddies, which are freestanding, are frequently not stable in use and overturn when wire is pulled from a reel or spool mounted thereon.

SUMMARY OF THE INVENTION

A wire or cable dispenser is disclosed which is adapted for use with a receiver hitch on the rear end of a vehicle. The dispenser comprises an elongated hollow drawbar having forward and rearward ends, upper and lower portions and opposite ends. The forward end of the drawbar includes a substantially square cross-section which is adapted for slidable insertion into the receiver hitch. The receiver hitch has a substantially square cross-section with an inside dimension which is larger than the outside dimension of the forward end of the drawbar and is adapted to receive a portion of the forward end of the drawbar. The dispenser also includes an elongated hollow support member having first and second ends and opposite sides. The first end of the support member is selectively pivotally secured about a horizontal axis transverse to the longitudinal axes of the drawbar and the support member. The support member is selectively movable between first and second positions with respect to the drawbar. The support member, when in its first position, generally overlies the drawbar and is substantially parallel thereto. The support member, when in its second position, extends upwardly and rearwardly from the second end of the drawbar. The drawbar and the support member have a plurality of horizontally extending openings formed therein which are transversely disposed with respect to the longitudinal axes thereof. Elongated rods, having opposite ends, are positioned in at least some of the horizontally extending openings so that the opposite ends thereof are disposed on opposite sides of the drawbar and/or support member. The opposite ends of the rods are adapted to rotatably receive a wire or cable spool thereon.

The dispenser of this invention also includes a unique storage means for stowing the elongated rods when not being used. The elongated rods are stowable within the interiors of the drawbar and the support member and are prevented from inadvertently sliding from the drawbar and the support member by means of removable caps at the ends thereof. A unique pin retainer means is also mounted on the drawbar for stowing the various pins used on the dispenser when not being used so as to prevent the loss or misplacement thereof. The dispenser of this invention is easily foldable for transport and storage.

It is therefore a principal object of the invention to provide an improved wire dispenser.

A further object of the invention is to provide a wire or cable dispenser.

Yet another object of the invention is to provide a wire or cable dispenser which may be used with a receiver hitch.

Yet another object of the invention is to provide a wire or cable dispenser which is secured to a vehicle receiver hitch and which may be easily moved from an operative position to a stowed position.

Yet another object of the invention is to provide a wire or cable dispenser including convenient and unique means for stowing spool support rods therein when the rods are not being used.

Still another object of the invention is to provide a wire or cable dispenser including a pin retainer means for stowing the pins of the dispenser when the pins are not being used.

These and other objects will be apparent to those skilled in the art.

DETAILED DESCRIPTION OF THE INVENTION

Figure 1:
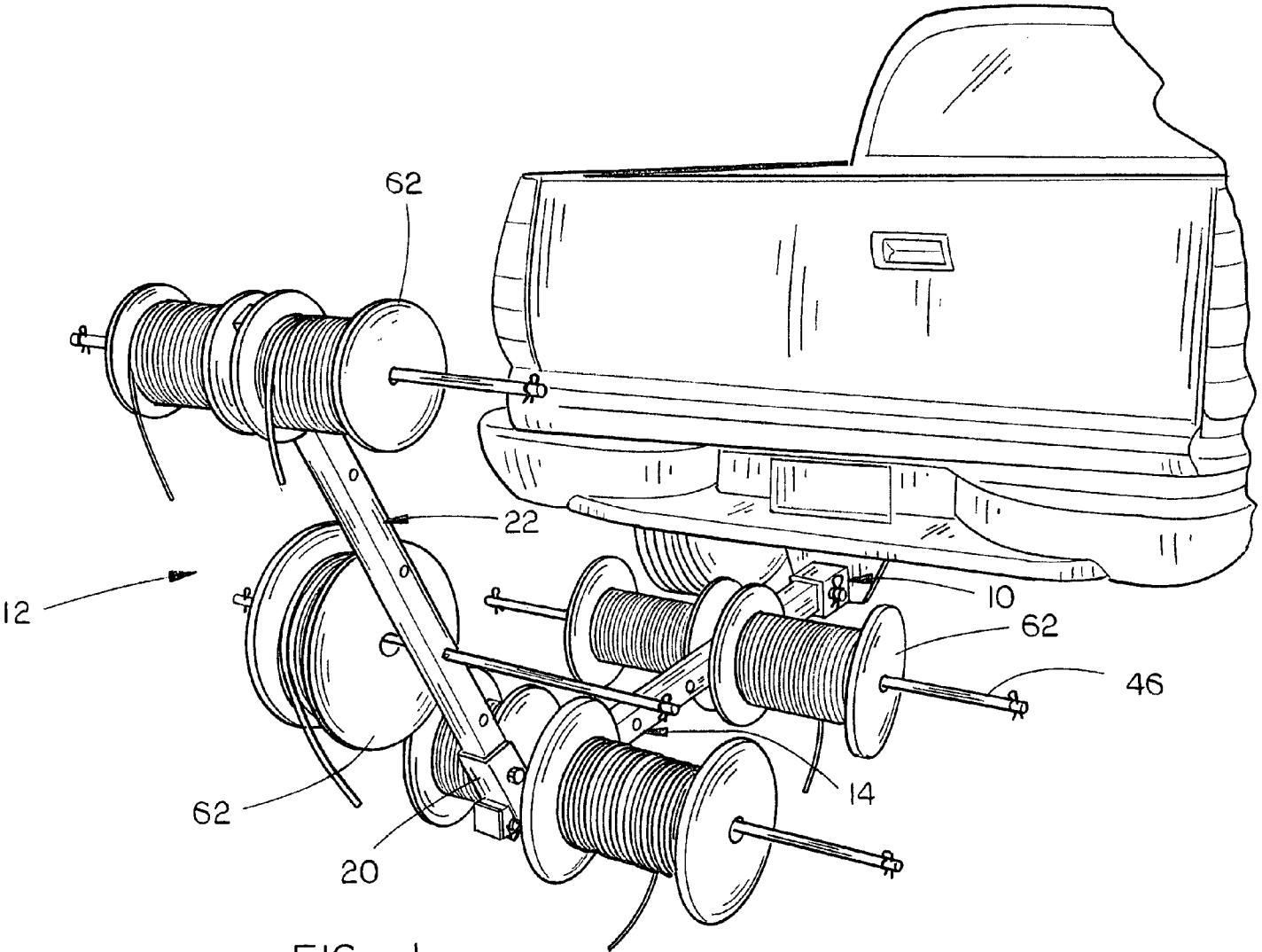
FIG. 1 is a rear perspective view of the wire or cable dispenser of this invention mounted on the receiver hitch of a vehicle.
Figure 2:
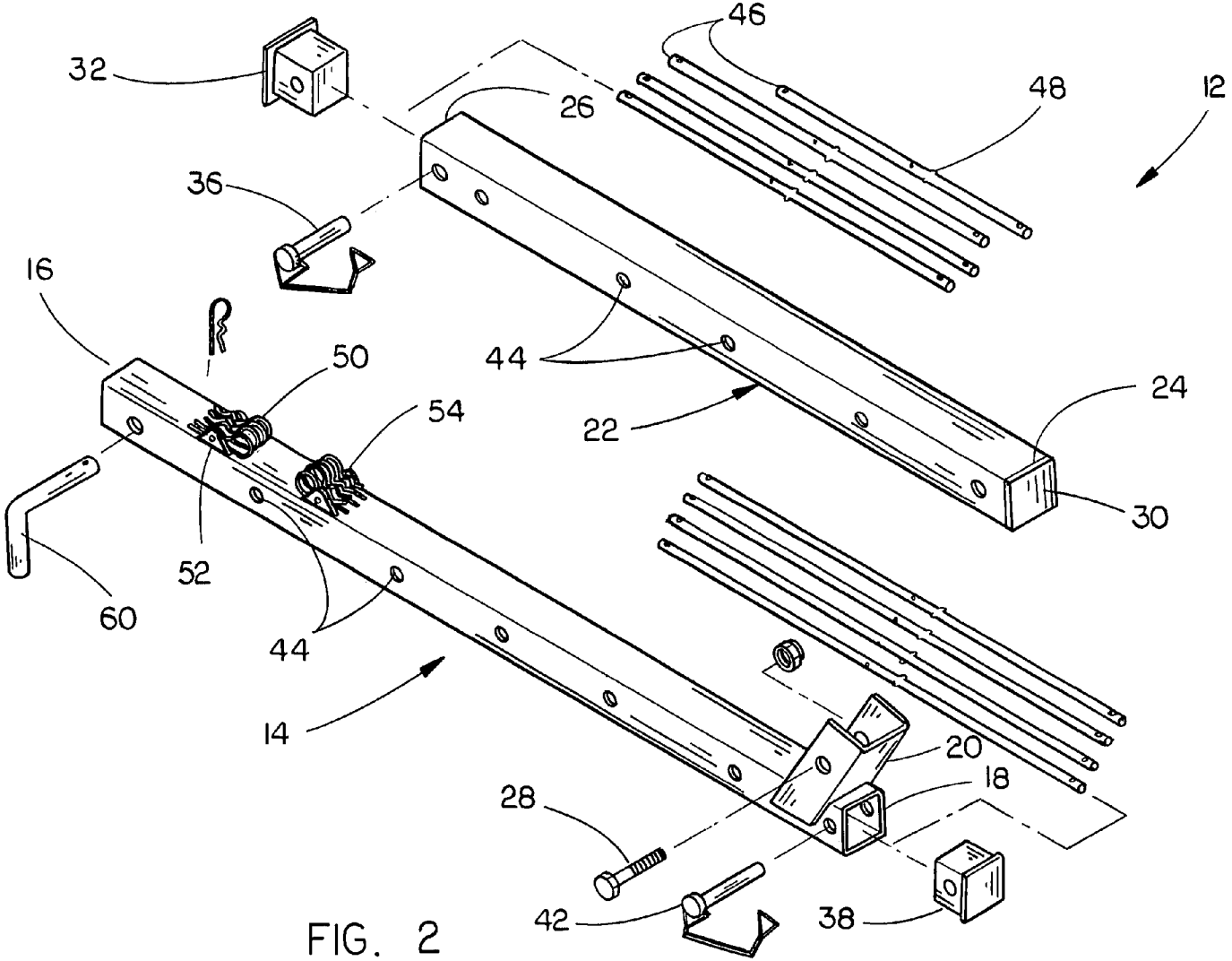
FIG. 2 is an exploded perspective view of the wire or cable dispenser of this invention.

In the drawings, the numeral 10 refers to a typical hitch receiver commonly found on vehicles such as pickups, trucks, SUVs, etc. The typical hitch receiver 10 has a square cross-section and is adapted to receive conventional drawbars. In the instant invention, the conventional drawbar is not utilized.

The numeral 12 refers to the wire dispenser of this invention and the same may also be used for cables such as used in the cable television industry. Even though the dispenser will be described as being a wire dispenser, it should be noted that it may be used as a wire or cable dispenser as noted above. Dispenser 12 includes an elongated hollow drawbar 14 having a forward end 16 and a rearward end 18.

A U-shaped channel member 20 is secured to the rearward end 18 of drawbar 14 by welding or the like and extends upwardly and rearwardly therefrom. Although the channel member 20 could extend vertically upwardly from the rearward end 18 of drawbar 14, it is preferred that the channel member 20 extend upwardly and rearwardly from drawbar 14 since the dispenser will tend to remain in a more stable condition when in its operative position.

The numeral 22 refers to an elongated hollow support member having a first end 24 and a second end 26. The first end 24 of support member 22 is pivotally secured about a horizontal axis transverse to the longitudinal axes of drawbar 14 and support member 22 by means of a bolt or pin 28. The first end 24 of support member 22 is closed by a cap 30 welded thereto. The second end 26 of support member 22 is selectively closeable by means of a cap 32 which is inserted thereinto and which is maintained therein by retainer 36. The rearward end of drawbar 14 is closed by means of a cap welded thereto. The forward end of the drawbar 14 is selectively closed by cap 38 and maintained therein by retainer 42.

Figures 3, 5:
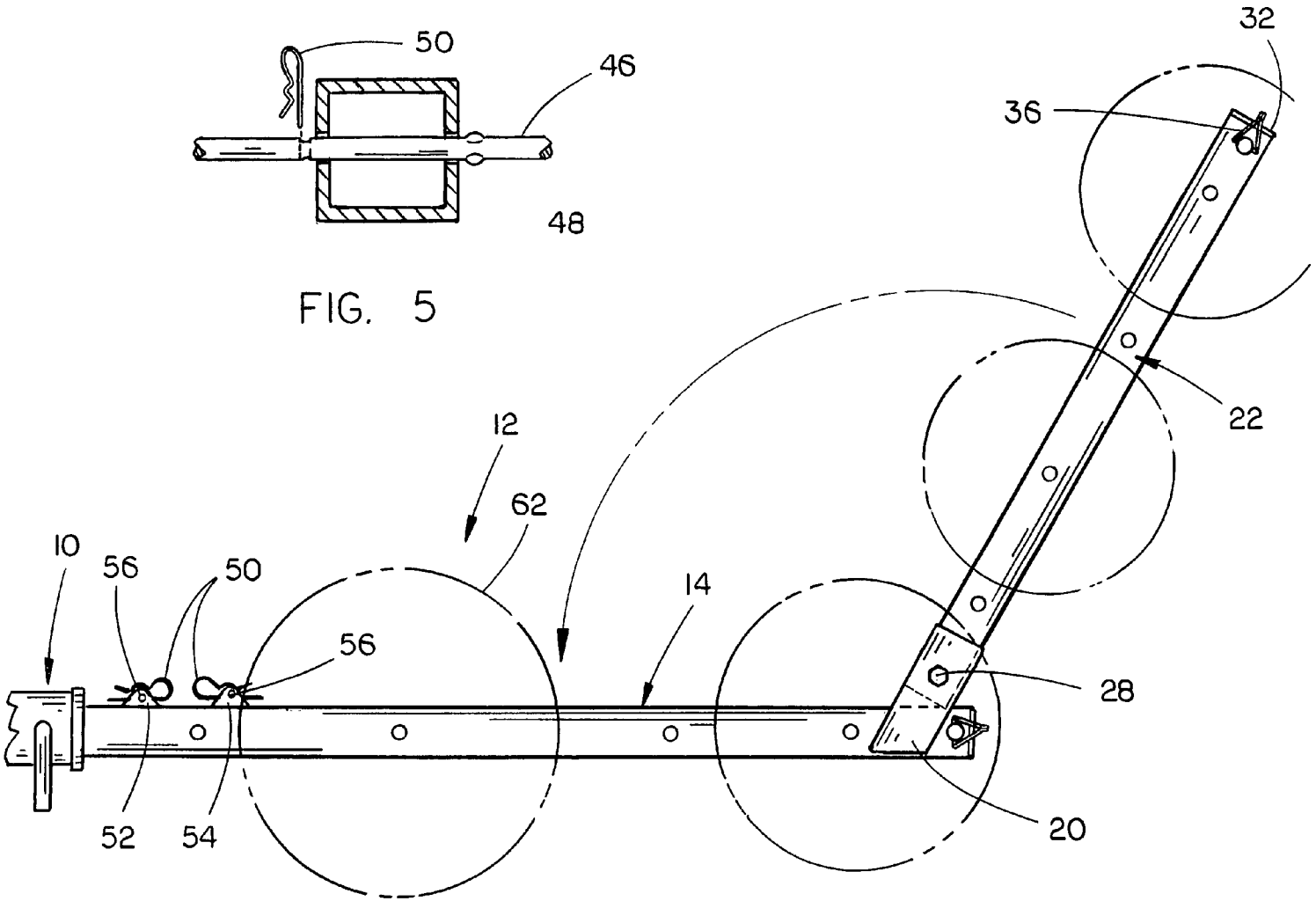
FIG. 3 is a side elevational view of the wire or cable dispenser of this invention.
FIG. 5 is a sectional view illustrating the manner in which the rods are secured to the apparatus.

Each of the drawbar 14 and support member 22 are provided with a plurality of horizontally extending openings 44 formed therein which are spaced-apart and which are adapted to receive elongated rods 46 therein in a manner so that the opposite ends thereof will be positioned at opposite sides of the drawbar and support member. Each of the rods 46 is provided with a weld abutment 48 near the center length thereof which is designed to abut against the side of the drawbar or support member to limit the movement of the rod 46 in one direction (FIG. 5). Each of the rods 46 has a pin 50 extending therethrough at the other side of the drawbar or support member to maintain the rod 46 in the opening 44 (FIG. 5). Each of the rods 46 has an opening formed in each of its ends adapted to receive a pin 50 therein.

A pair of pin retainers or receptacles 52 and 54 are provided for stowing the pins 50 thereon when not being used to prevent their loss or misplacement. Each of the pin receptacles 52 and 54 include a horizontally extending cylindrical rod member 56 which is secured at its opposite ends to the upper portion of the drawbar by welding or the like so that the cylindrical member 56 is spaced above the drawbar. The spring pins 50 are simply slipped onto the cylindrical rod members 56 and the spring action of the pins 50 maintains the pins 50 on the cylindrical rod members 56.

Figure 4:
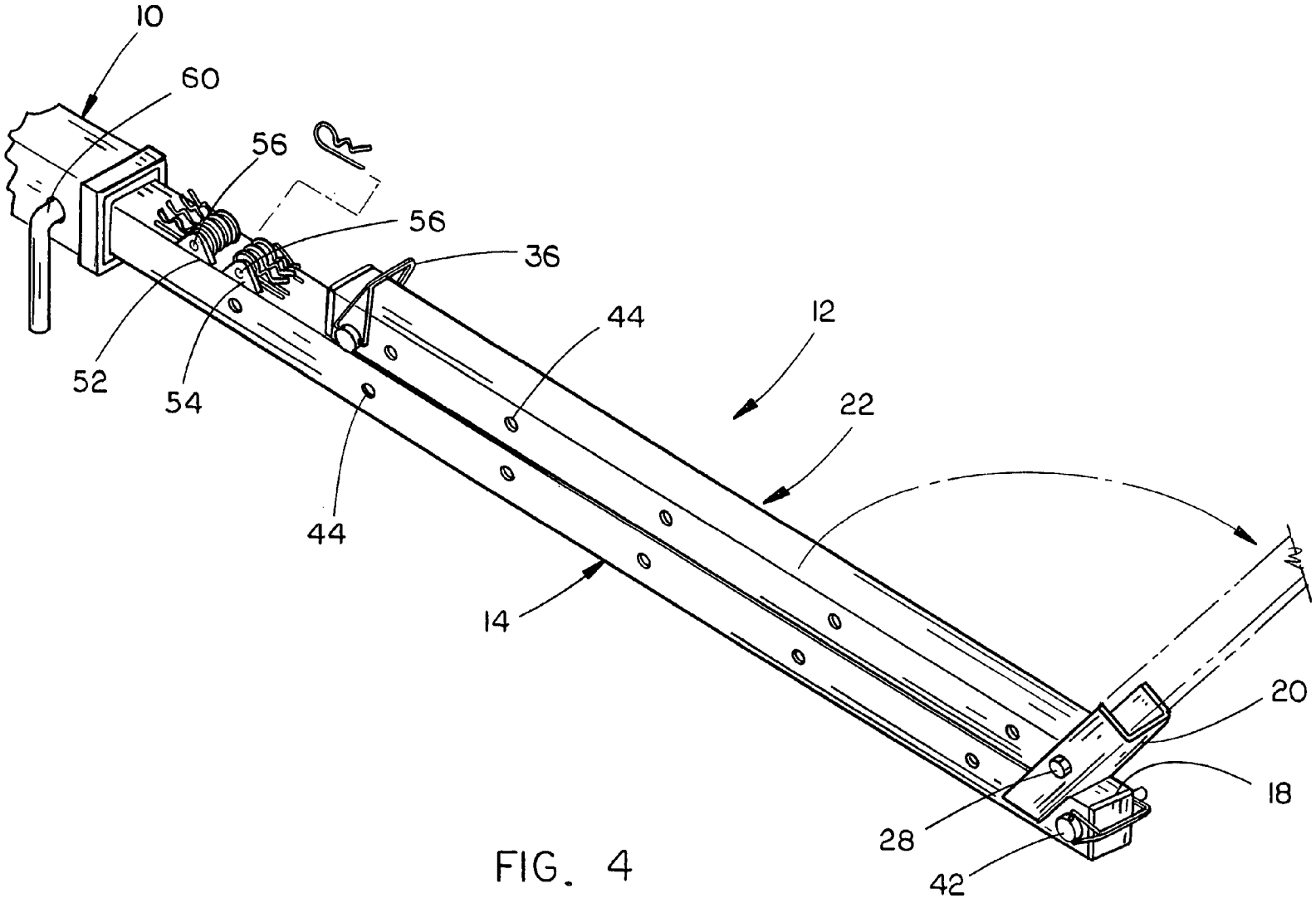
FIG. 4 is a rear perspective view of the wire or cable dispenser illustrating the dispenser in its folded position.

The dispenser of this invention is used as follows. Assuming that the support member 22 is in its stowed position adjacent drawbar 14, as seen in FIG. 4, the forward end 16 of drawbar 14 is inserted into the hitch receiver 10 in conventional fashion and is pinned therein by means of a conventional hitch receiver pin 60. The support member 22 is then pivotally moved upwardly from the drawbar 14 to the position of FIG. 3 until the lower end of the support member 22 is received by the U-shaped channel 20 which further limits the rearward movement thereof. Rods 46 are then inserted into the various openings 44 for supporting reels or spools 62 thereon. The rods 46 are maintained in the various openings 44 by the pins 50. Spools 62 are then inserted onto the outer ends of the rods 46 and maintained thereon by means of pins 50 extending through the holes formed in the outer ends of the rods 46 outwardly of the outer sides of the spools 62. It is preferred that some of the openings 44 have larger diameters than others so that larger and heavier rods may be inserted thereinto for supporting larger spools or reels 62 having the wire or cable mounted thereon.

The electrician or the like simply pulls the wire from the spools as needed. If long runs of wire are needed, such as between streetlights or the like, the free ends of the wires may be anchored at one location and then the vehicle may be driven forwardly so that the wire will be pulled from the appropriate spools as the vehicle approaches the end of the run.

When the dispensing operations have been completed, the spools are removed from the ends of the rods 46 and the rods 46 are removed from the drawbar 14 and the support member 22. The rods are easily stowed within the drawbar 14 and/or the support member 22 by simply removing caps from the ends thereof and inserting the rods into the interiors of the drawbar and support member. The caps are then replaced and maintained therein by the pins.

Thus it can be seen that a novel wire dispenser has been provided for use with a vehicle hitch which positions the spools in a convenient manner so as not to interfere with one another and to provide a dispenser which is easily folded into a transport or stowed position which occupies very little space.

Thus it can be seen that the invention accomplishes at least all of its stated objectives.

I claim:

1. A wire or cable dispenser adapted for use with a receiver hitch, comprising:

an elongated hollow drawbar having forward and rearward ends, upper and lower portions, and opposite sides;

said forward end of said drawbar including a substantially square cross-section which is adapted for slidable insertion into the receiver hitch;

said rearward end of said drawbar being disposed opposite to said forward end of said drawbar;

the receiver hitch having a substantially square cross-section with an inside dimension which is larger than the outside dimension of said forward end of said drawbar and being adapted to receive a portion of said forward end of said drawbar;

an elongated hollow support member having first and second ends and opposite sides;

said first end of said support member being selectively pivotally secured about a horizontal axis transverse to the elongated axes of said drawbar and said support member;

said support member being selectively movable between first and second positions with respect to said drawbar;

said support member, when in its said first position, generally overlying said drawbar and being substantially parallel thereto;

said support member, when in its said second position, extending upwardly and rearwardly from said second end of said drawbar;

said drawbar and support member having a plurality of horizontally extending openings formed therein which are transversely disposed with respect to the longitudinal axes thereof;

elongated rods, having opposite ends, positioned in at least some of said horizontally extending openings so that the opposite ends thereof are disposed on said opposite sides of said drawbar and/or said support member;

each of said opposite ends of said rods adapted for rotatably receiving a wire or cable spool thereon;

said elongated rods provided with a plurality of pins for maintaining said rods on either said drawbar or said support member; said drawbar having at least one pin retainer mounted thereon;

said pin retainer comprising an elongated cylindrical member which is spaced above said upper portion of said drawbar by supports at the opposite ends thereof to which pins may be attached thereto.

* * * * *